US008197199B2

(12) United States Patent
Perry et al.

(10) Patent No.: US 8,197,199 B2
(45) Date of Patent: Jun. 12, 2012

(54) TURBOCHARGER HOUSING WITH A CONVERSION COATING AND METHODS OF MAKING THE CONVERSION COATING

(75) Inventors: Thomas A. Perry, Bruce Township, MI (US); Carnell E. Williams, Pontiac, MI (US); Julian Velosa, Novi, MI (US); Anil K. Sachdev, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 790 days.

(21) Appl. No.: 12/326,339

(22) Filed: Dec. 2, 2008

(65) Prior Publication Data

US 2009/0304500 A1 Dec. 10, 2009

Related U.S. Application Data

(60) Provisional application No. 61/059,983, filed on Jun. 9, 2008.

(51) Int. Cl.
*F04D 29/02* (2006.01)

(52) U.S. Cl. ..... 415/200; 415/217.1

(58) Field of Classification Search ..... 415/200, 415/217.1, 229; 148/218
See application file for complete search history.

(56) References Cited

U.S. PATENT DOCUMENTS

| | | | | |
|---|---|---|---|---|
| 6,478,894 | B1 * | 11/2002 | Mitamura et al. | 148/328 |
| 6,925,806 | B1 * | 8/2005 | Zollinger et al. | 60/602 |
| 2003/0162267 | A1 | 8/2003 | Pompejus et al. | |
| 2003/0167767 | A1 | 9/2003 | Arnold | |
| 2005/0011192 | A1 | 1/2005 | Ohishi | |
| 2008/0000550 | A1 | 1/2008 | Holly et al. | |

FOREIGN PATENT DOCUMENTS

| | | |
|---|---|---|
| CN | 1128301 | 8/1996 |
| CN | 1526052 | 9/2004 |
| CN | 101050517 | 10/2007 |
| CN | 101096986 | 1/2008 |

OTHER PUBLICATIONS

Easterday, J., "Liquid Ferritic Nitrocarburizing", Nitromet Division of Jolene Corproation, Technology Update, pp. 1-10.

* cited by examiner

*Primary Examiner* — Stephen W Smoot
(74) *Attorney, Agent, or Firm* — Dierker & Associates, P.C.

(57) ABSTRACT

A turbocharger includes a center housing having a bearing surface configured to contact an inner surface of a unison ring. A conversion coating is impregnated onto at least the bearing surface of the center housing.

7 Claims, 2 Drawing Sheets

TURBOCHARGER HOUSING WITH A CONVERSION COATING AND METHODS OF MAKING THE CONVERSION COATING

CROSS-REFERENCE TO RELATED APPLICATIONS

This application claims the benefit of U.S. Provisional application Ser. No. 61/059,983, filed Jun. 9, 2008, which application is incorporated herein by reference.

TECHNICAL FIELD

The present disclosure relates generally to turbocharger housings with a conversion coating, and methods of making the conversion coating.

BACKGROUND

Turbochargers for diesel engines control the amount of turbo boost by controlling the flow of exhaust gas onto the turbine blades. Such control is accomplished by an internal actuator that opens and closes a set of vanes that are collectively held by a unison ring. A linear actuator pushes on a slot in the unison ring, which is constrained on its inside diameter by a machined feature on the turbocharger center housing. The constraint causes the linear motion to be converted to rotational motion.

SUMMARY

A turbocharger includes a center housing having a bearing surface configured to contact an inner surface of a unison ring. A conversion coating is impregnated onto the bearing surface of the center housing.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Failed turbochargers often result from the vanes sticking in undesirable positions. It is believed that the present inventors have discovered at least one of the heretofore unknown causes of the sticking vanes. As shown in the example below, the inventors have found that sticking vanes are the result of corrosion and wear of the turbocharger housing at the point where a loaded unison ring contacts the turbocharger housing. In order to reduce or eliminate the corrosion and wear that leads to sticking vanes, and thus extend the service life of the turbocharger, the inventors are passivating at least the portion of the turbocharger housing that contacts the unison ring. The added coating advantageously reduces the friction between the unison ring and a bearing surface of the turbocharger housing which contacts the unison ring.

Figure 1A:
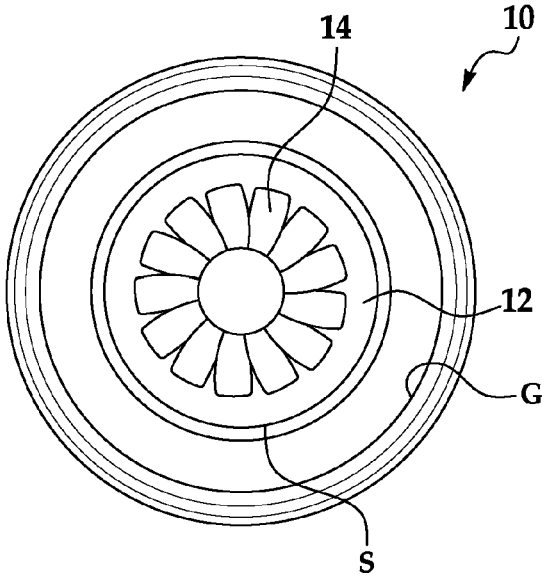
FIG. 1A is a top view of an example of a turbocharger.
Figure 1B:
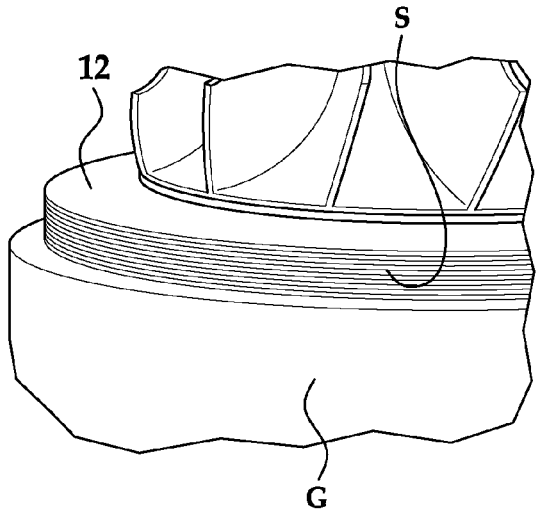
FIG. 1B is a cutaway side view of the turbocharger of FIG. 1A.
Figure 2:
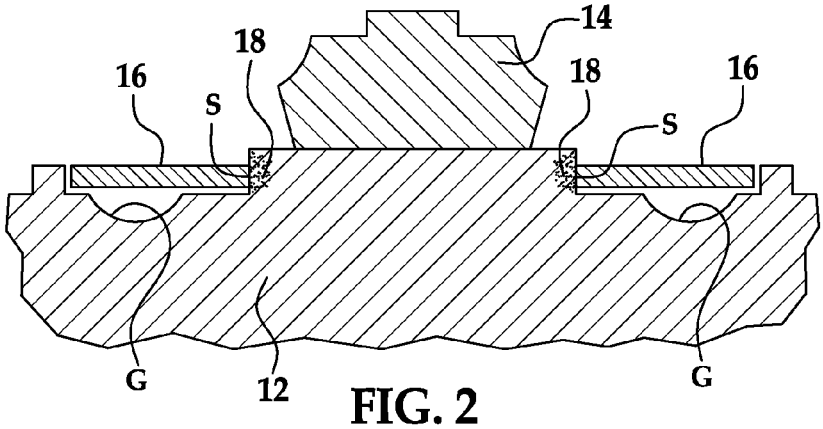
FIG. 2 is a cut-away semi-schematic cross-sectional view of an example of a turbocharger.

In FIGS. 1A and 1B, a top view and a side cutaway view of a turbocharger 10 and its center housing 12 are depicted. In FIG. 2, a cross sectional view of the turbocharger 10, including the unison ring 16, is depicted. Very generally, the turbocharger 10 includes turbine blades 14 operatively connected to the turbocharger housing 12. The turbocharger center housing 12 includes a bearing surface S configured to contact the unison ring 16, and a recessed annular groove G for receiving exhaust gases, and directing such gases to the turbine blades 14.

The turbocharger center housing 12 is formed of nodular iron (ductile iron) or stainless steel. Nodular iron is suitable for the turbocharger center housing 12, at least in part because nodular iron may be exposed to operating conditions (e.g., extreme temperatures) that are not suitable for other iron materials, such as, for example, grey cast iron. Furthermore, nodular iron may be treated by heat treatments or chemical conversion processes, such as those described herein, to improve performance.

The turbocharger center housing 12 disclosed herein includes a conversion coating 18 (shown as speckles) impregnated into at least the bearing surface S. In some instances, the entire center housing 12, including the bearing surface S (also referred to herein as the hub) and the groove G, may have the conversion coating 18 impregnated therein. The surface of the housing 12 into/on which the conversion coating 18 is formed may be a finished machined surface (i.e., additional machining is not needed), or an unfinished machined surface (i.e., additional machining may be desirable).

It is believed that the conversion coating 18 will reduce or eliminate corrosion and wear of the turbocharger center housing 12, and thus reduce or eliminate the undesirable sticking of the vanes. Still further, it is believed that the conversion coating 18 increases the turbocharger's ability to withstand thermal cycles having temperatures ranging from about 700° C. to about 780° C. Other wear resistant coatings, such as chemical or physical vapor deposited diamond-like carbon or transition metal nitrides, or thermal sprayed coatings, are deleteriously affected by such conditions due, at least in part, to coefficient of thermal expansion mismatches and/or adhesion issues. Since the conversion coating 18 disclosed herein is integral with the metal of the turbocharger center housing 12, it is further believed that it is not susceptible to delamination.

A non-limiting example of such a conversion coating 18 is formed via ferritic nitrocarburizing. The ferritic nitrocarburizing process is accomplished at temperatures below the service temperature of the turbocharger 10 (i.e., the temperature conditions to which the turbocharger 10 is exposed when in use in a vehicle), which ranges from about 700° C. to about 800° C. The lower temperatures advantageously keep the turbocharger center housing 12 from warping during processing.

While a ferritic nitrocarburizing process is described further hereinbelow, it is believed that other methods of nitriding may also be used to form the conversion coating 18. Examples of such other processes include gas nitrocarburizing or plasma nitrocarburizing.

Any of the nitrocarburizing processes disclosed herein may include a cleaning and pre-heating cycle (which takes place at about 400° C.). This cycle substantially ensures that at least the bearing surface S (or the entire surface of the center housing 12) is clean and dry. When the ferritic nitrocarburizing process is used, the pre-treatment process is also believed to reduce thermal shock and permit more efficient recovery of the nitrocarburizing bath temperature.

Since the present inventors found that the bearing surface S is the portion of the center housing 12 that deleteriously affects the vanes, it is desirable to form the conversion coating 18 at this portion of the housing. As such, a mask (examples of which are discussed hereinbelow) may be used to selectively form the coating 18 on the bearing surface S, while the remainder of the housing 12 is uncoated. However, it is believed that the conversion coating 18 does not deleteriously affect the remainder of the housing 12, and as such, the coating 18 may be formed on the entire housing 12 surface (including the groove G).

When forming the coating 18 via plasma nitrocarburizing, a masking process may be utilized to selectively form the conversion coating 18 on particular surfaces of the center housing 12. Using plasma nitrocarburizing, it is to be understood that the coating 18 forms where the ion current flows to the surfaces. As such, masking may be used to control the voltage and current flow to the surfaces, thus controlling the coating 18 location. Such techniques may be particularly suitable when it is desirable to form the conversion coating 18 on the bearing surface S alone. In one instance, masking may be accomplished by physically encasing the surfaces of the center housing 12 where plasma nitrocarburizing treatment is undesirable. For example, all surfaces of the center housing 12 except for the bearing surface S may be covered by the mask (not shown), which may be shaped like a box that surrounds the desirable surfaces. The exposed bearing surface S and the mask will be exposed to the plasma nitrocarburizing process, but the surfaces underlying or surrounded by the mask will remain untreated. A non-limiting example of such a physical mask is formed of a conductor material, such as, for example, low carbon steel (e.g., 1020) or stainless steel (e.g., 303 and 304). Generally, aluminum and galvanized steel are not suitable masking materials. In another instance, masking may be accomplished by insulating one or more of the surfaces where plasma nitrocarburizing treatment is undesirable. When the surface(s) are insulated, the ion current is not able to flow to such surfaces, and thus such surface(s) remain untreated. Non-limiting examples of the insulating mask include a refractory (ceramic) cloth or wool (e.g., KAOWOOL® available from Thermal Ceramics Inc., Augusta, Ga.) or ceramic plugs. Insulating materials/masks may be incorporated into one or more holes of the surfaces that are to remain untreated.

In an example in which the conversion coating 18 is applied to the entire housing 12 surface, the housing 12 is exposed to a gas nitrocarburizing process. Using gas nitrocarburizing, it is to be understood that the coating 18 forms where the gas reacts with the exposed surfaces.

In another example in which the conversion coating 18 is applied to the entire housing 12 surface, the housing 12 is immersed into a nitrocarburizing salt bath such that each surface is exposed to the contents of the bath for a predetermined time. It is to be understood that the time of exposure to the nitrocarburizing salt bath depends, at least in part, on the desirable depth for the conversion coating 18 into the housing 12.

The liquid salt bath obtains its source of nitrogen and carbon through sodium and potassium salts containing cyanates (CNO—) and carbonates. The non-cyanide salts are formulated to be fluidic at the processing temperature (580° C.), and to generate nitrogen and carbon activity within the bath, thus producing a desired epsilon iron nitride. It is to be understood that the nitrogen and carbon activity may be controlled by monitoring and regulating the cyanate concentration. As the center housing 12 is immersed into the liquid bath, the following catalytic reaction occurs at the surface, whereby the cyanate breaks down to release nitrogen and carbon. Both elements diffuse into the housing 12 surface causing a change in the element concentration at the surface and within the subjacent zone.

A non-limiting example of the reactions that takes place are:

$$8CNO^- = 2CO_3^{=} + 4CN^- + CO_2 + 4N + C \quad 1)$$

$$4N + 12Fe = 4Fe_3N \quad 2)$$

$$C + 3Fe = Fe_3C \quad 3)$$

After the predetermined time for the nitrocarburizing salt bath has expired, the center housing 12 is quenched into an oxidizing salt bath at a lower temperature, for example, 400° C., for a predetermined time. In a non-limiting example, the exposure to the oxidizing bath ranges from about 5 minutes to about 20 minutes. It is believed that the intermediate quenching using the oxidizing bath reduces the cooling rate of the housing 12, thereby mitigating thermally induced distortion.

After the oxidizing quench, the center housing 12 is cooled to room temperature and is rinsed. In some instances, it may be desirable to perform post treatment processes, such as, for example, mechanical polishing or other machining processes.

The result of the above ferritic nitrocarburizing method is a compound layer of iron and nitrogen/carbon at the treated surface of the center housing 12. This compound layer includes predominantly epsilon iron nitride, a phase generally identified as $Fe_3N$. A relatively small volume of gamma prime iron nitride ($Fe_4N$) may also be present at the interface of the base metal and compound layer. Subjacent to the compound layer, diffused nitrogen of lower concentration (less than 0.20% just beneath the compound layer) forms a solid solution with the base metal iron. This is generally referred to as the diffusion zone. It is to be understood that the thickness of this zone depends, at least in part, on the time the housing 12 is in the salt bath and the activity of the salt bath. In some instances, the thickness of the diffusion zone is about 15 microns or less.

The conversion coating 18 may also include microporosity, which varies in depth depending, at least in part, on the materials used and the process parameters/conditions.

To further illustrate embodiment(s) of the present disclosure, an example is given herein. It is to be understood that this example is provided for illustrative purposes and is not to be construed as limiting the scope of the disclosed embodiment(s).

EXAMPLE

An analysis of components from failed turbochargers illustrated to the inventors that the vane sticking problem is caused, at least in part, by corrosion and wear of the turbocharger housing at the point where the loaded unison ring contacts it.

The samples evaluated were housings and rings from vehicles with sticking vanes. The housing hub and unison ring inner diameter were in contact with each other in the vehicle. Some scratching between the parts was noted, and the ring did not rotate freely around the hub except in an arc limited by the vane length (approx. 2 inches). The area of greatest wear is generally where the exhaust gas enters the housing and pushes the unison ring against the hub. The rings samples were previously ion nitrided to prevent wear between the ring and a separate pin, however, the hardened ring was scratching against the hub.

Figure 3:
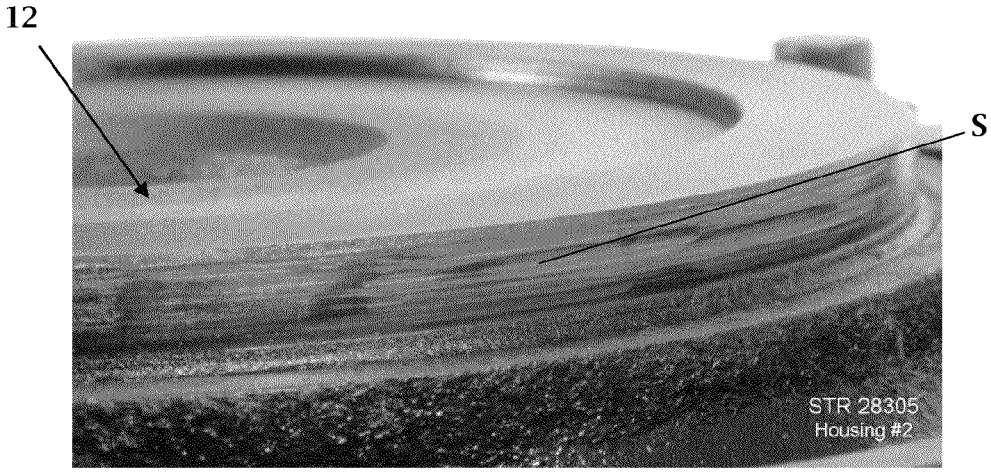
FIG. 3 is a photograph of a bearing surface of a center housing of a used turbocharger.
Figure 4A:
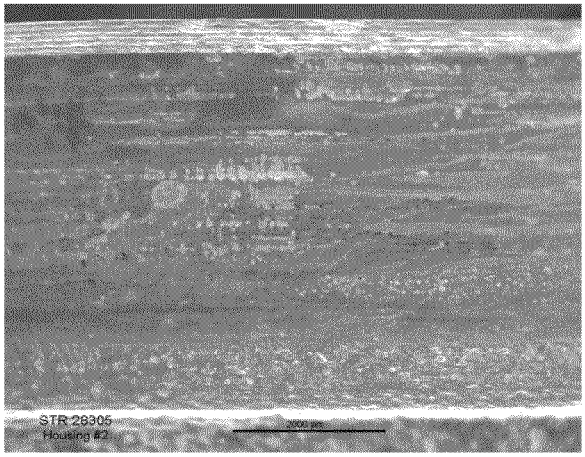
FIGS. 4A and 4B are scanning electron micrograph images of the bearing surface of the center housing of FIG. 3 at 12× magnification and 85× magnification, respectively.
Figure 4B:
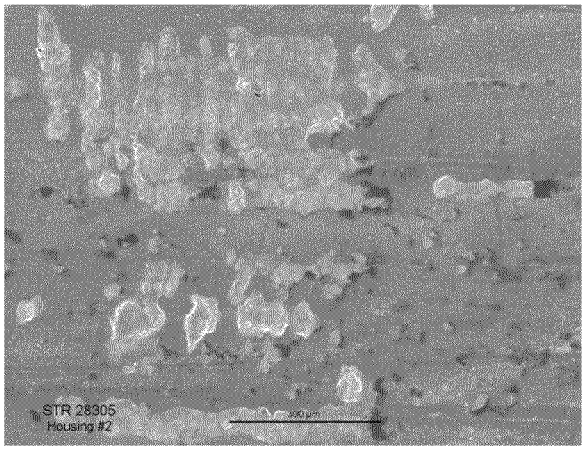

The housings and rings were analyzed using scanning electron microscopy. FIG. 3 is a photograph of the bearing surface of one of the analyzed housings, and FIGS. 4A and 4B are micrographs of the bearing surface of the housing shown in FIG. 3. The abnormal surface conditions on the housing bearing surfaces ranged from slight polish wear to severe gouging and significant material removal (see, e.g., FIGS. 4A and 4B). The comparable surfaces on the unison rings (not shown) evidenced polish, some limited mechanical deformation and the possible embedding of debris. The wear areas on the parts were confined to approximately 30° to 45° of arc where the exhaust gas enters the housing and where, reportedly, the ring is pushed against the housing.

It is to be understood that the term "connect/connected" or the like is broadly defined herein to encompass a variety of divergent connection arrangements and assembly techniques. These arrangements and techniques include, but are not limited to (1) the direct connection between one component and another component with no intervening components therebetween; and (2) the connection of one component and another component with one or more components therebetween, provided that the one component being "connected to" the other component is somehow operatively connected to the other component (notwithstanding the presence of one or more additional components therebetween).

While several embodiments have been described in detail, it will be apparent to those skilled in the art that the disclosed embodiments may be modified. Therefore, the foregoing description is to be considered exemplary rather than limiting.

The invention claimed is:

1. A turbocharger, comprising:

a center housing having a nodular iron bearing surface configured to contact an inner surface of a unison ring; and a conversion coating including $Fe_3N$ impregnated onto at least the bearing surface of the center housing.

2. The turbocharger as defined in claim 1 wherein the conversion coating is a ferritic nitrocarburized coating.

3. The turbocharger as defined in claim 1 wherein the conversion coating is gas nitrocarburized coating.

4. The turbocharger as defined in claim 1 wherein the conversion coating is a plasma nitrocarburized coating.

5. The turbocharger as defined in claim 1 wherein the bearing surface is a finish machined surface.

6. The turbocharger as defined in claim 1 wherein the conversion coating further includes $Fe_4N$.

7. A turbocharger center housing formed by the process of:

heating at least a nodular iron bearing surface of a center housing at a predetermined temperature;

exposing the at least the nodular iron bearing surface of the center housing to a nitrocarburizing salt bath at a temperature that is below a service temperature of the center housing, thereby impregnating a conversion coating including $Fe_3N$ onto at least the nodular iron bearing surface of the center housing;

exposing the at least the nodular iron bearing surface of the center housing to an oxidizing salt bath at a temperature that is below the temperature of the nitrocarburizing salt bath; and cooling the nodular iron bearing surface.

* * * * *